US005810271A

United States Patent [19]

Hamilton

[11] Patent Number: 5,810,271

[45] Date of Patent: Sep. 22, 1998

[54] ROLLER BOARD AND METHOD FOR LOADING THE SAME

[75] Inventor: Cheryl K. Hamilton, North Canton, Ohio

[73] Assignee: RJS Corporation, Akron, Ohio

[21] Appl. No.: 905,474

[22] Filed: Aug. 4, 1997

[51] Int. Cl.[6] ..... B65H 49/02; B65H 57/00; B65H 57/16

[52] U.S. Cl. ..... 242/131.1; 28/212; 28/213; 242/157 R; 242/615.2; 242/615.3; 226/189

[58] Field of Search ..... 242/131.1, 131, 242/157 R, 615.2, 615.3; 28/212, 207.1, 202, 213, 201; 226/189

[56] References Cited

U.S. PATENT DOCUMENTS

| | | | |
|---|---|---|---|
| 84,793 | 12/1868 | Boyden | 242/615.3 X |
| 2,422,353 | 6/1947 | Hitt | 242/615.3 |
| 3,317,979 | 5/1967 | Furst | 28/199 |
| 3,567,097 | 3/1971 | Baker | 242/615.3 |
| 4,019,700 | 4/1977 | King | 242/131.1 |
| 4,573,226 | 3/1986 | Smith | 242/157 R X |
| 4,973,006 | 11/1990 | James | 242/157 R X |

*Primary Examiner*—Michael Mansen
*Attorney, Agent, or Firm*—Renner, Kenner, Greive, Bobak, Taylor & Weber

[57] ABSTRACT

A roller board (16) for organizing a plurality of filaments (14) from spools (28) for delivery to a collection point, includes a first plurality of rollers (40) arranged to form spaces (42) therebetween, and a second plurality of rollers (44), each pivotable at one end (80) positioned proximate the first plurality of rollers (40), the second plurality of rollers (44) oriented substantially perpendicular to the first plurality of rollers, wherein the plurality of filaments (14) are individually positioned in the spaces and the second plurality of rollers are selectively pivoted to enclose the filaments.

21 Claims, 8 Drawing Sheets

ROLLER BOARD AND METHOD FOR LOADING THE SAME

TECHNICAL FIELD

Generally, the present invention relates to a roller board for use in quickly organizing steel cords between a creel and a steel cord calender for calendering tire plies. More particularly, the present invention relates to a roller board which has an array of vertically disposed rollers proximally positioned near an array of individually pivoted, cantilevered horizontal rollers. More specifically, the present invention relates to a roller board which has vertical spaces between vertical rollers for receiving steel cords therein, wherein the successively lowermost open horizontal roller is pivoted to enclose steel cords in their respective windows and wherein this process—receiving steel cords in vertical spaces and successively closing the lowermost open horizontal roller—is repeated until each steel cord or predetermined number of cords from the creel is selectively positioned in the windows created by the array of horizontal and vertical rollers.

BACKGROUND ART

In manufacturing tires it is commonly known to position steel cords in the layers of material used to form tire ply stock. The steel cord reinforces the tire ply stock to add strength and durability to the finished tire. Great care must be taken to ensure that each cord is accurately aligned and delivered to the calender with uniform and specific tension.

Current systems for paying out steel cords employ a creel which provides a frame upon which multiple spools or bobbins of steel cord are rotatably mounted. The spools are positioned in a matrix upon the frame wherein each spool is associated with a tensioning device. A typical creel may payout anywhere between a few to 1000 or more strands of steel cord. Typically positioned at the elevational front of each horizontal row of steel cord spools is a front plate with eyelets, a grooved roller, or a front roller board through which the steel cords are organized prior to delivery to the calender. The eyelets are provided with a ceramic ring insert or other hardened material to absorb wear and to minimize cord tension variation attendant a change of direction. A grooved roller, while reducing friction, does not lend itself to a lateral directional change. In other words, the grooved roller tends to allow the cord to jump out of the roller whenever the cord exits to a side of the roller. A front roller board provides a series of fixed horizontal rollers positioned in front of a series of fixed vertical rollers which form window openings at the intersection of the spaces between adjacent vertical and horizontal rollers.

Threading the steel cords into the front eyelet plate or front roller board is a time consuming process. When front eyelet plates are used an operator must thread each steel cord individually into the eyelet. Threading an eyelet is difficult because of the close proximity of other eyelets and because previously threaded cords may partially obstruct access. Care must also be taken to ensure that the cord from a particular spool is threaded through the appropriate eyelet. Grooved rollers have the problem that steel cords are not captured and do not allow for lateral direction changes of the steel cord. Front roller boards may be used in place of front eyelet plates in instances where the steel cord angle is greater than, for example, 10°, so that "curling" of the cord as it passes the roller board is minimized. Roller boards, which may have vertical rollers behind or in front of horizontal rollers, are typically quite thick. This makes the threading process difficult as the cord, which may tend to curl or droop, must be precisely inserted through the window opening. To do this, the operator must endeavor to look directly through the window opening which may be anywhere from 8" to 80" from the floor. Use of the roller board also requires that the end of the inserted cord be secured while other cords are inserted through the window. Otherwise, an inserted cord may recede back through the opening causing confusion and delay in reestablishing its proper position in the roller board. Normally, spool loading and threading of the cords takes place while another creel row is running. It will be appreciated that loading the spools onto the frame and then threading the front roller boards or front eyelet plate is extremely time consuming and may take longer than the creel run itself, causing machine down time and loss of production capacity.

After threading of the front eyelet plate or front roller board is complete, all of the cords may be threaded into a main eyelet plate or main roller board which organizes the cords into a minimal area of prescribed width near the calender entrance. The cords are then calendered into rubber materials to make a sheet of tire ply stock.

DISCLOSURE OF THE INVENTION

Therefore, an object of the present invention is to provide a cord organizing system used in the manufacture of tire ply stock, wherein a plurality of steel cords are delivered from a creel to a calender with uniform prescribed tension in a compact area of predetermined width. Another object of the present invention is to provide a cord organizing system used in the manufacture of tire ply stock which greatly reduces the amount of time spent in threading the steel cords to attain a single compact area of predetermined width prior to entry into the calender. Still another aspect of the present invention is to provide a cord organizing system which may have utility in relation to arranging or cabling a plurality of cords or wires into a desired configuration prior to entry into a predetermined manufacturing station.

Another object of the present invention is to provide a cord organizing system which utilizes a front and/or main roller board between the creel and the calender to align and minimize additional tension in the steel cords. A further object of the present invention is to provide a plurality of vertical rollers which are freely rotatable in either direction and which provide vertical spaces therebetween for receiving steel cords therein. Yet another object of the present invention is to provide a roller board with a plurality of vertical rollers wherein the top of each roller is tapered to allow for easy insertion of a steel cord into the vertical space.

Another object of the present invention is to provide a cord retainer or clamping device, independent of the roller board, which temporarily retains steel cords from spools in a creel row, wherein the clamping device provides a plurality of longitudinal slots with tapered openings sized to grip a steel cord in each slot. A further object of the present invention is to provide the same center-to-center spacing for the longitudinal slots of the clamping device and the vertical spaces of the roller board to facilitate loading of cords into the roller board. Yet another object of the present invention is to employ a rubber-like material for the construction of the retaining device. Still another object of the present invention is to provide a method for using the retaining device wherein a steel cord from a spool on the creel row is loaded and secured into a predetermined slot and wherein the retaining device is transported manually or mechanically to receive additional steel cords from each spool in a like manner. Yet another object of the present invention is to transport the collected steel cords while retaining their organization and to permit their easy insertion into respective vertical spaces. Still yet another object of the present invention is to provide a handle for the retaining device.

Another object of the present invention is provide the roller board with a plurality of horizontal rollers on either side of the plurality of vertical rollers, wherein each of said plurality of horizontal rollers is pivotable away from the plurality of vertical rollers and wherein the lowermost horizontal roller may be fixed. Still another object of the present invention is to provide a pivot pin extending upwardly from a frame, wherein each horizontal roller is individually mounted on the pivot pin and pivots thereabout. Yet another object of the present invention is to provide a latching mechanism for each horizontal roller at an end opposite the pivot pin for selectively holding the horizontal roller in place. A further object of the present invention is to provide a method of loading the cords into the roller board wherein all of the horizontal rollers, except the lowermost horizontal roller, are unlatched and pivoted to allow entry of the steel cords into every vertical space. Still another object of the present invention is to provide a method of pivoting and latching the successively lowermost horizontal roller after insertion of the steel cords into their respective vertical spaces, and wherein this process is repeated until all of the steel cords are threaded through the roller board. Still yet a further object of the present invention is to provide a retainer bar which is disposed over the vertical rollers after all the horizontal rollers are latched to maintain the position of the vertical rollers during a manufacturing run.

Another object of the present invention is to provide a main roller board, which may include a plurality of vertical rollers and at least one pivotable and latchable horizontal roller, wherein the main roller board organizes the steel cords for passage from the front roller boards to the calender. Still another object of the present invention is to provide a method of transporting each retaining device loaded with steel cords placed in the front roller board to the appropriate vertical spaces of the main roller board, and pivoting and closing the appropriate horizontal roller of the main roller board to allow delivery of the steel cords to the calender.

In general, the present invention contemplates a roller board for organizing filaments or cords from respective spools for delivery to a collection point, including a first plurality of rollers having spaces therebetween; and a second plurality of rollers, each pivotable at one end and proximally positioned near said first plurality of rollers, said second plurality of rollers oriented substantially perpendicular to said first plurality of rollers, wherein a selected number of filaments are positioned in said spaces and said second plurality of rollers are selectively pivoted to enclose the selected filaments.

PREFERRED EMBODIMENT FOR CARRYING OUT THE INVENTION

Figure 1:
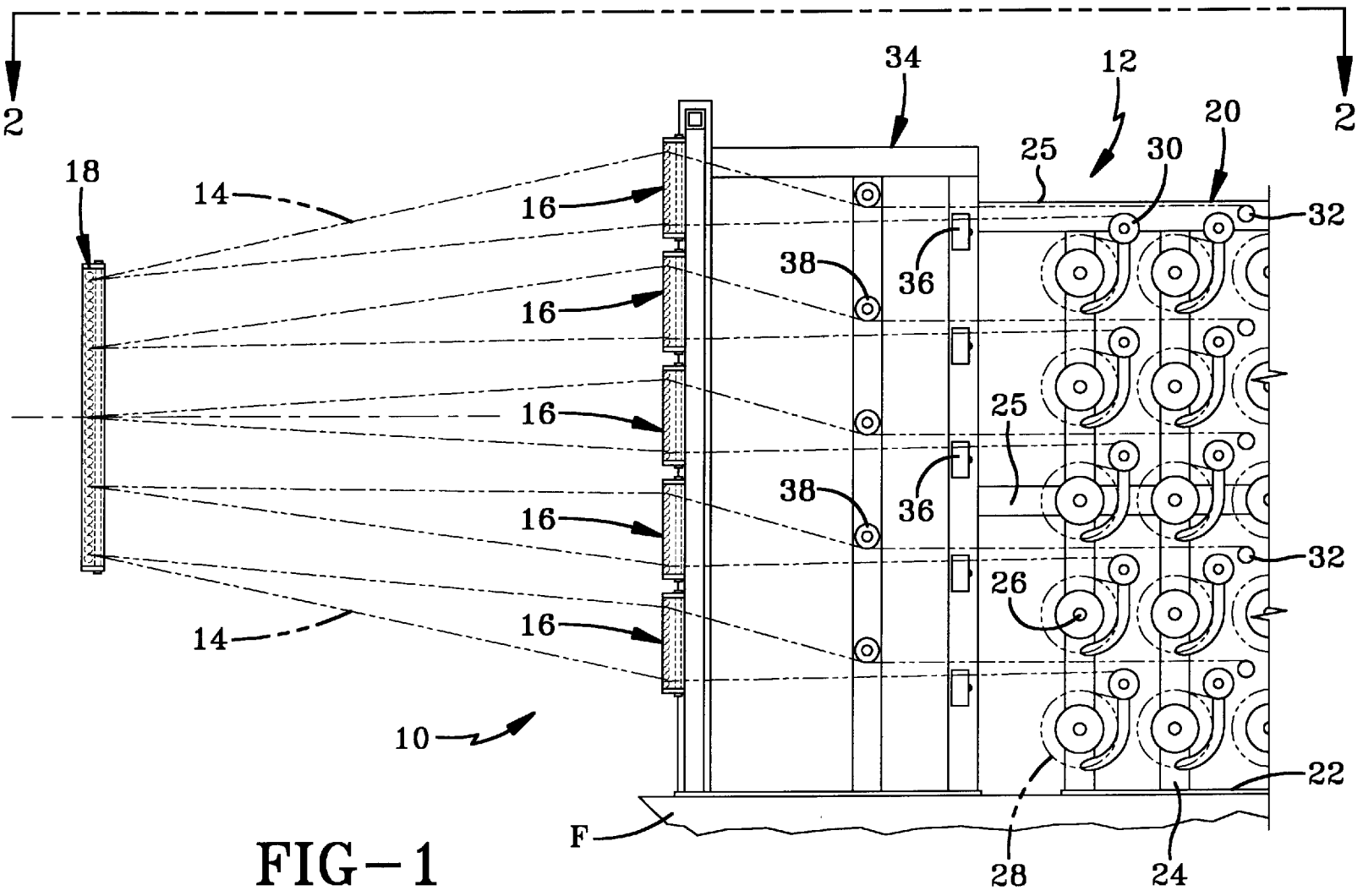
FIG. 1 is a fragmentary elevational view of a cord organizing system with front roller boards disposed in front of each horizontal row of steel cord spools.
Figure 2:
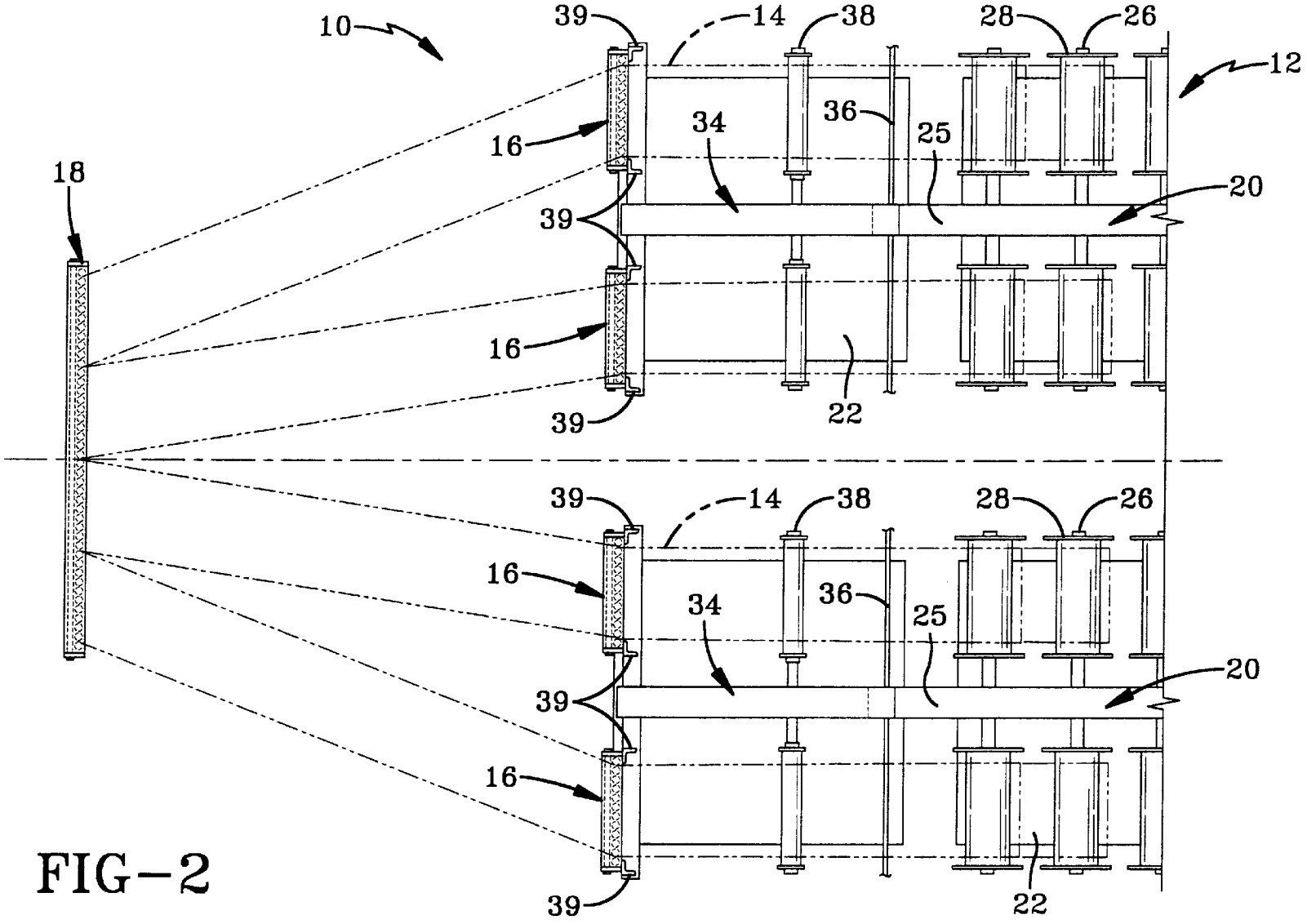
FIG. 2 is a fragmentary top plan view of the cord organizing system taken substantially along line 2—2 of FIG. 1.
Figure 3:
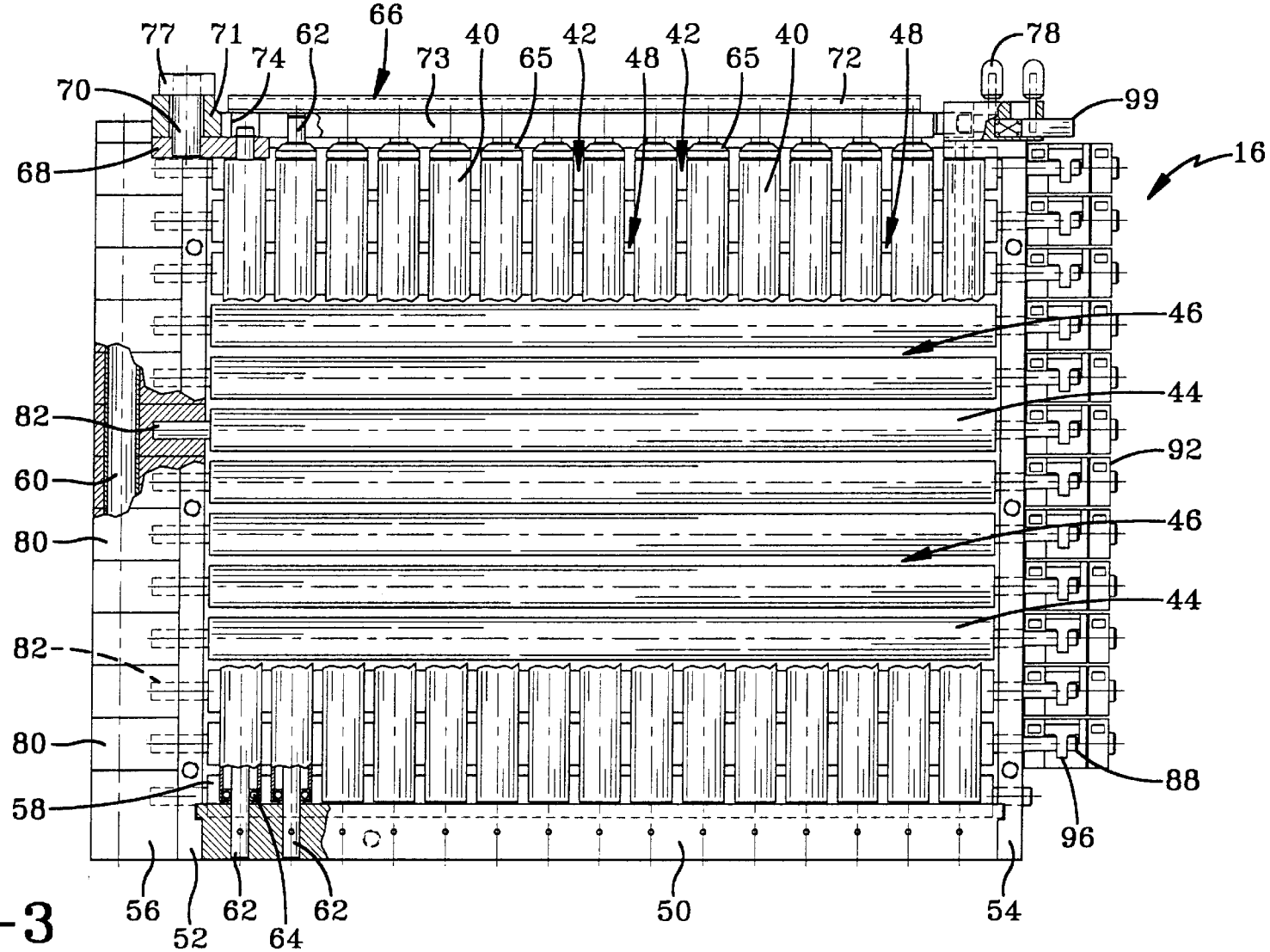
FIG. 3 is a rear elevational view, partially broken away, of a front roller board according to the present invention.
Figure 4:
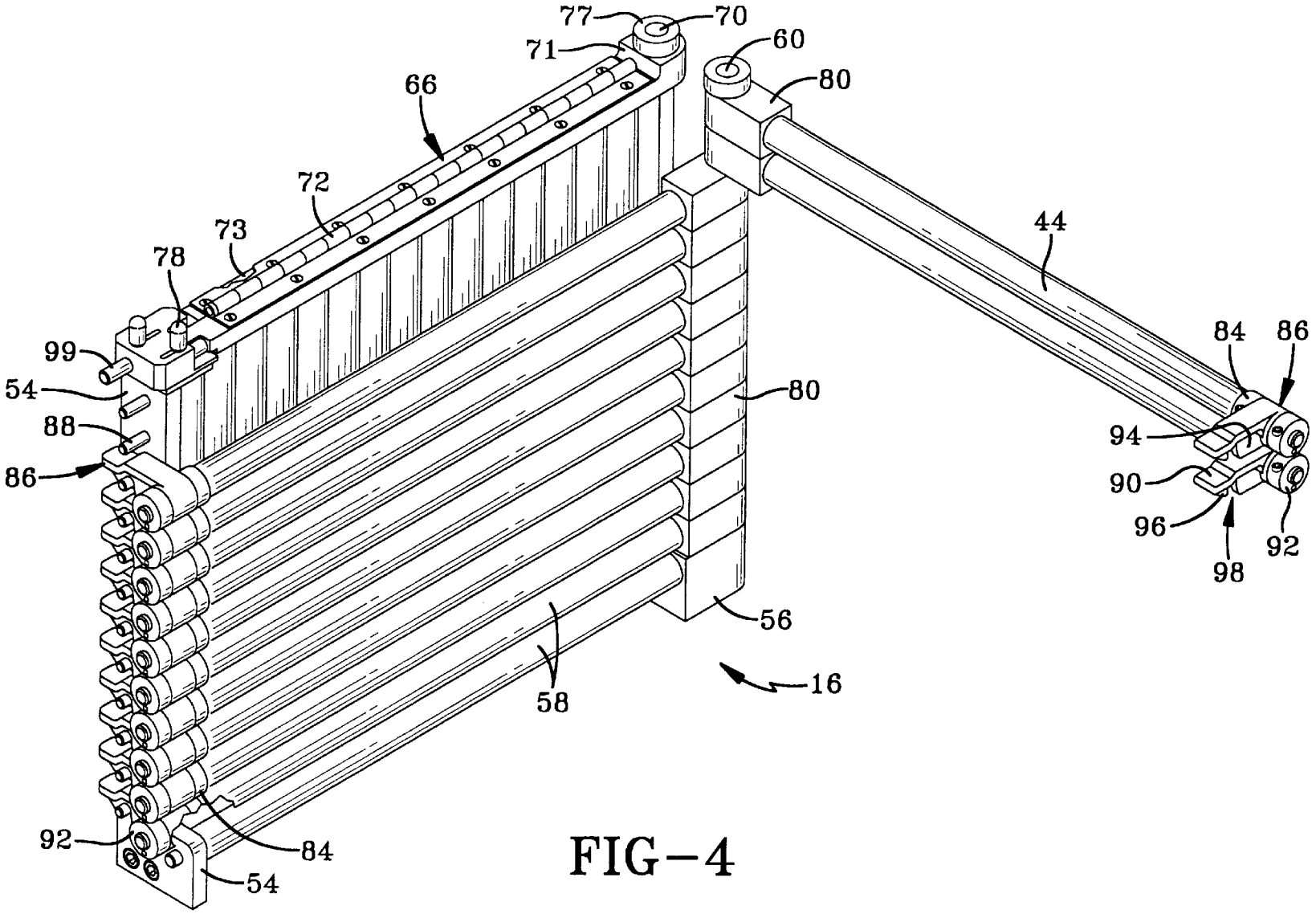
FIG. 4 is a front perspective view of the front roller board of FIG. 3 showing latched and unlatched horizontal rollers according to the present invention.
Figure 5:
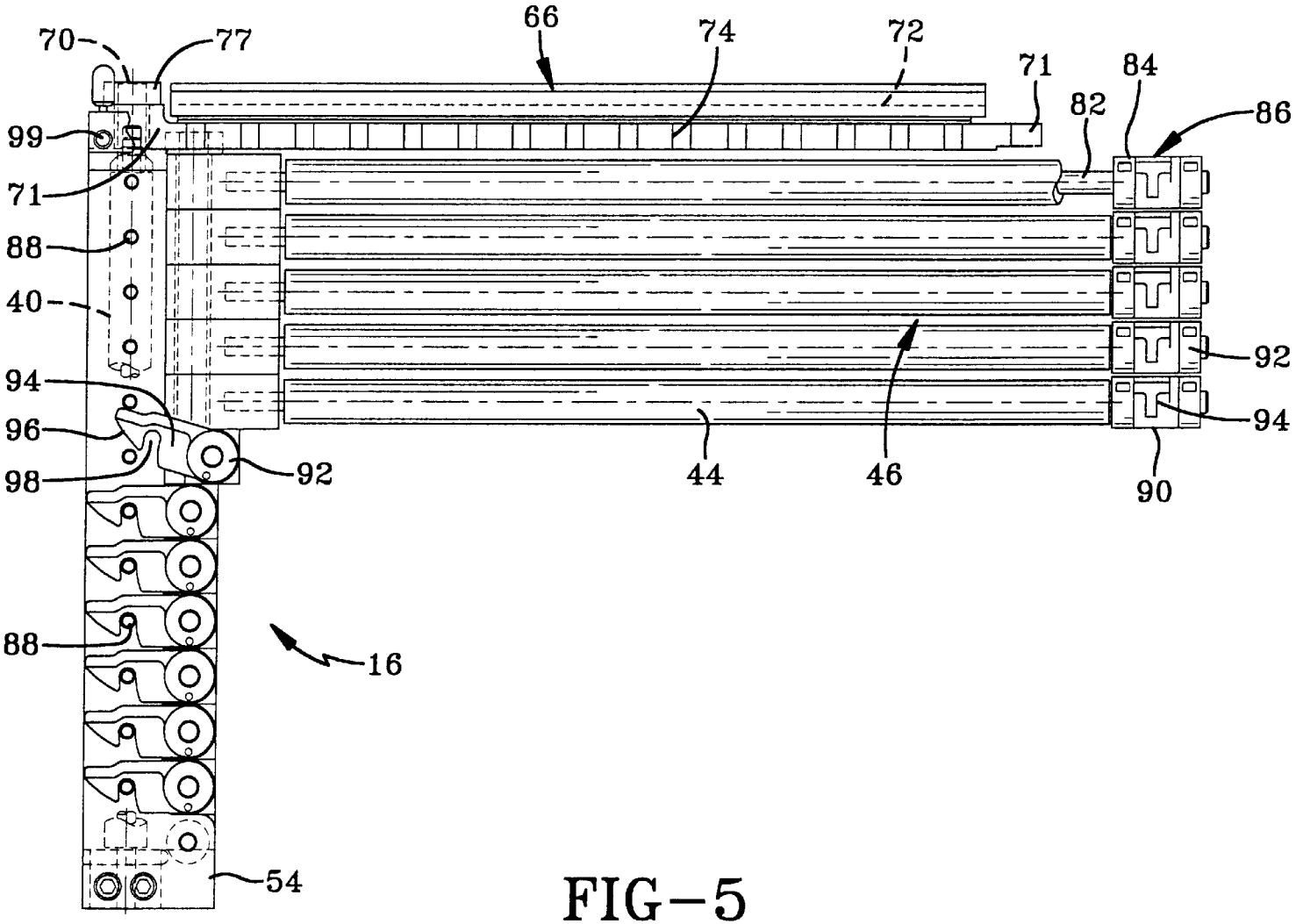
FIG. 5 is a side elevational view of the front roller board of FIG. 3.
Figure 6:
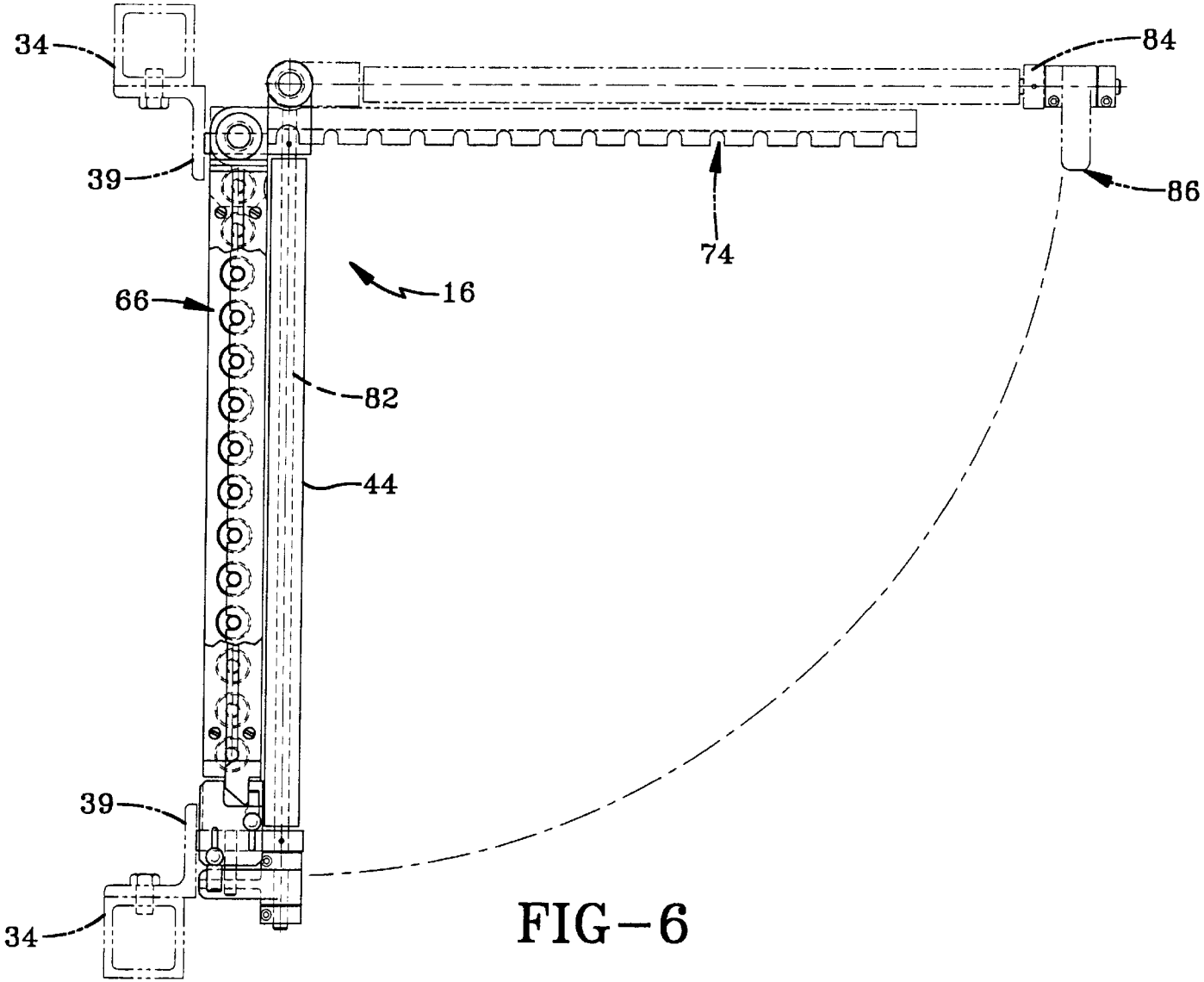
FIG. 6 is a top plan view of the front roller board of FIG. 3.

A steel cord organizing system according to the concepts of the present invention is depicted in FIGS. 1 and 2 of the drawings and is generally indicated by the numeral 10. The purpose of the organizing system 10 is to unreel a plurality of steel cords from their respective spools or bobbins for delivery to a final work station in an organized manner with controlled tension on the cords. The organizing system 10 includes a creel, generally indicated by the numeral 12, for delivering a plurality of steel cords 14 to a plurality of front roller boards, generally indicated by the numeral 16, which organize the cords 14 for delivery to a main roller board 18. The main roller board 18 configures the cords in one plane of prescribed width for entry into a calender (not shown) used in the manufacture of plies for tires or other reinforced elastomeric products. Although the organizing system 10 presented herein is of a type which may be used in conjunction with the manufacture of tires, it will be appreciated that the use of the front roller boards 16 may also be employed in any application where multiple filaments or strands of wire, cord, string or textile material is to be cabled or delivered to a collection point in a manufacturing operation. It will also be appreciated that the features and structure of the front roller board 16 described below may be incorporated into the main roller board 18.

The creel 12 includes a frame, generally indicated by the numeral 20, that is supported by a platform 22 which rests upon the floor of a manufacturing facility designated by the letter "F." Extending upwardly from the platform 22 are a plurality of support columns 24 which are connected to one another by a plurality of crossbeams 25 that are substantially perpendicular thereto. As best seen in FIG. 2, a plurality of spindles 26 extend transversely from each side of each of the support columns 24. Although FIG. 2 depicts two frames 20, it will be appreciated that only one or more than two frames may be employed depending upon the number of wires to be delivered. Additionally, a frame 20 may have any number of support columns 24 to support any number of spindles 26. Loaded upon each spindle 26 is a spool or bobbin 28 which carries wire, steel cord, textile material or the like. Those skilled in the art will appreciate that the creel 12 may be used to carry between a few to 1,000 or more spools 28 of cord 14. A tension controller 30 may be associated with each spindle 26 to regulate the tension of each cord 14 as it is delivered to the front roller boards 16. A plurality of support rollers 32 may be provided to directionally guide the cords 14 and prevent tangling with cords 14 from other spools 28.

Positioned in front of the frame 20 is a post-creel frame, generally indicated by the numeral 34, which may mount loose cord detectors 36 and/or direction change rollers 38. Also mounted to the post-creel frame 34 are the front roller boards 16. It will be appreciated that a front roller board 16 is associated with each row of spindles 26 from one side of a frame. Those skilled in the art will appreciate that the roller boards 16 may be sized to be substantially the axial dimension of a row of spindles loaded with spools 28. Otherwise, delivery of cords from one row of spools 28 of the creel 12 would interfere with adjacent rows. This arrangement prevents tangling and possible breakage of the cords 14. Each roller board 16 is mounted to the post creel frame 34 by a mounting bracket 39 and appropriate fastening means.

Referring now to FIGS. 3–6 and 8, it can be seen that the front roller board 16 includes a plurality of generally vertically oriented rollers 40 in a first plane with a space 42 provided between each roller 40. In a second plane, substantially parallel with the first plane of rollers 40, is a plurality of individually pivotable horizontal rollers 44 which are oriented substantially perpendicular to the plurality of vertical rollers 40. In between each horizontal roller 44 is a slot 46. The intersection of each of the spaces 42 and each of the slots 46 forms a window 48 for receiving one or more cords 14. In the preferred embodiment, rollers are rotatable shafts; however, as used herein, the term "rollers" may also designate fixed cylinders made of hardened steel, ceramic or other material. In any event, the rollers, rotatable or fixed, provide a low-friction engagement with the cords 14.

As shown, the front roller board 16 employs fixed cantilevered vertical rollers 40 and cantilevered horizontal rollers 44 that individually swing open or away from vertical rollers 40, allowing one layer of cords, up to 14 in this embodiment, to be loaded between the vertical rollers in one motion using a clamping device. Once the lowermost horizontal roller 44 is pivoted and secured into position, a next layer of cords is then loaded. This process is repeated until all the windows 48 are filled. By employing the front roller board in this manner, the time for loading wires therein is greatly reduced. Use of the front roller board 16 also maintains the organization of the wires so that they may be loaded all at one time into a main roller board.

The front roller board 16 includes a base 50 with a vertical column 52 extending from one end and a vertical column 54 extending from an opposite end. A pivot pin base 56 is connected to a side of the vertical column 52 opposite the base 50. A base roller 58 extends horizontally between the vertical column 52 and the vertical column 54. A pivot pin 60 extends upwardly from the pivot pin base 56.

Each vertical roller 40 includes a vertical axle 62 extending upwardly from the base 50. Disposed between each vertical axle 62 and its respective roller 40 are bearings 64 to allow the roller to freely rotate in either a clockwise or counter-clockwise direction. The top of each roller 40 has a taper 65 to ease loading of the cords 14 into their respective space 42. It will be appreciated that the outermost vertical rollers are fixed and not cantilevered. Nor is it required that the outermost vertical rollers have a taper at their respective tops.

A cap bar 66, which is carried by the vertical column 52, provides a means for enclosing the spaces 42 after all the cords 14 are loaded into the front roller board 16. The purpose of the cap bar 66 is to maintain alignment and secure the plurality of vertical rollers 40 to counter side thrust forces from the cords 14 as they are pulled into the calender. The cap bar 66 bears on a plate 68 which is integral with the top of the vertical column 52. A cap pin 70 extends downwardly into the plate 68 and receives a rotatably movable bushing bar 71. A hinge 72 is provided along the length of the bushing bar 71 to interconnect a closable flap 73 thereto. A plurality of notches 74 are provided in the bushing bar 71 that are aligned with each vertical roller 40 to receive the top of each respective axle 62. An end notch 76 is provided on the bushing bar 71 opposite the cap pin 70 to provide a clearance when the cap bar 66 is closed and placed adjacent the latching vertical column 54. A head 77 of cap pin 70 is provided to secure the bushing bar 71 to the plate 68. The cap bar 66 is securable to the vertical column 54 by a spring loaded pin 78.

One end of each horizontal roller 44 includes a block 80 wherein the lowermost horizontal base roller 58 is supported by the pivot pin base 56. Each successive roller 44 is supported by the adjacent block 80. A cantilever axle 82 extends from each block 80 to carry its respective horizontal roller 44. A spacer collar 84 is provided on each axle 82 to provide vertical stability to the cantilevered axle. Similar to the vertical rollers bearings are provided to allow free rotation of the horizontal rollers 44 in either a clockwise or counter-clockwise direction.

At the end of each axle 82, opposite the blocks 80, is a latching mechanism, generally indicated by the numeral 86, which is securable to a respective individual peg 88 extending transversely from the latching vertical column 54. The latching mechanism 86, which may be spring loaded, includes a projecting finger 90 that is rotatable on an axle 82. A collar 92 secures the finger 90 to the axle 82. Extending downwardly from the finger 90 is a rib 94 which has a leading edge 96 and a notch 98 that receives the peg 88. The finger 90 is rotatable upon the axle 82 and is sized to fit between successive pegs and latch upon a respective peg 88. It will be appreciated that each latching mechanism 86 may or may not be positively secured by the latching mechanism above. In any event, the mechanism 86 is designed so that the horizontal rollers 44 are secured in their closed position during the steel cord run. A spring loaded pin 99 extends from the vertical column 54 to positively secure the uppermost latch 86 to its respective peg 88.

Figure 7:
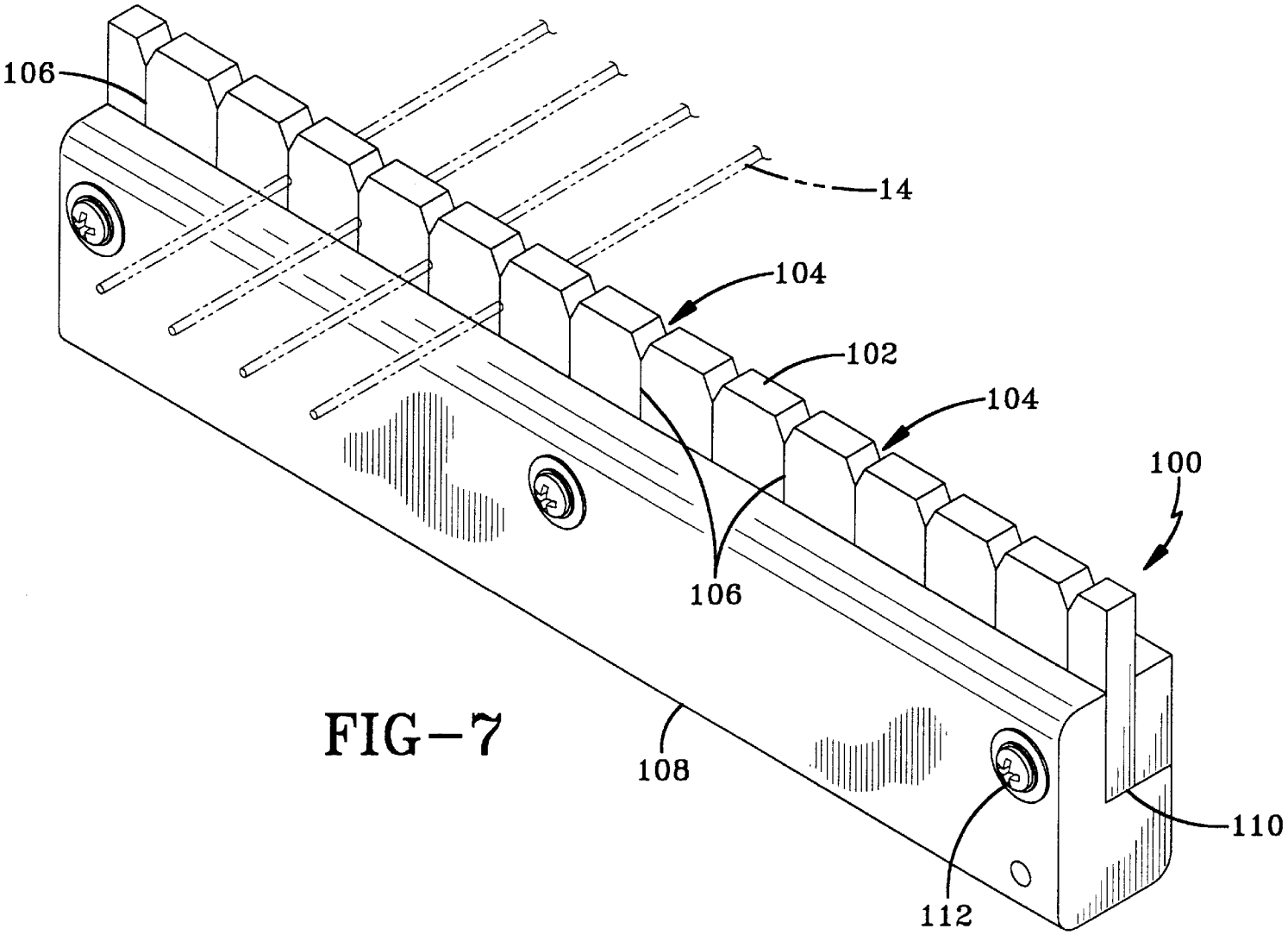
FIG. 7 is a perspective view of a retaining device.
Figure 8:
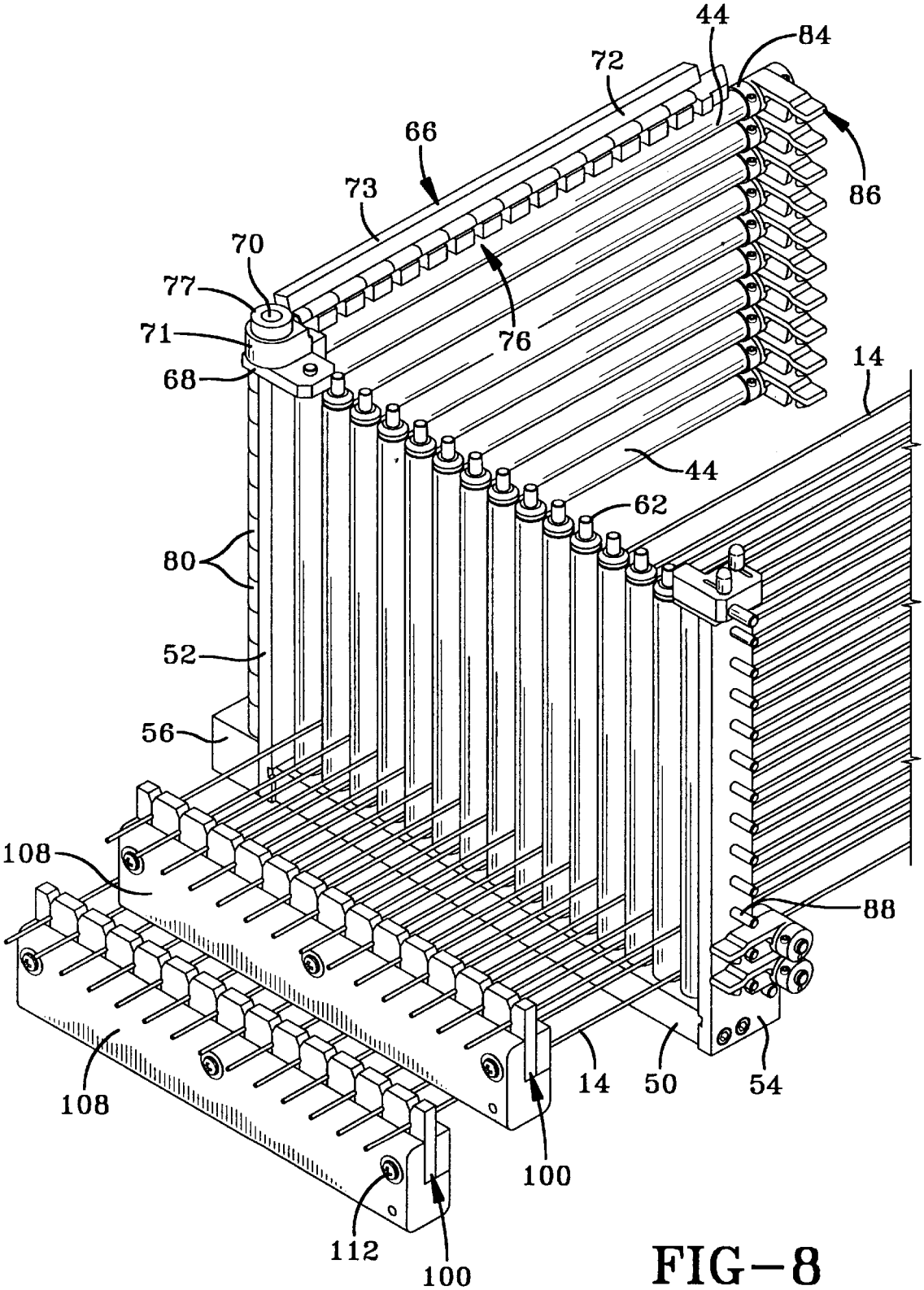
FIG. 8 is a rear perspective view of the front roller board showing steel cords inserted between vertical rollers, enclosed by horizontal rollers, and held by clamping devices.

To facilitate loading of the cords 14 into the front roller board 16 a comb or retaining device, as shown in FIG. 7 and generally indicated by the numeral 100, may be used. The comb 100 has a longitudinal edge 102 with a plurality of v-notches 104 provided for receiving individual cords 14. Extending further into the comb 100 from the v-notches 104 are slits 106 which holds the cords in place while other cords 14 are loaded into their respective slits. The center-to-center spacing of the slits 106 matches or is equivalent to the center-to-center spacing of the spaces provided by the plurality of vertical rollers 40. A handle 108 may be positioned over an opposite longitudinal edge 110 and secured to the comb 100 by fasteners 112.

In operation, after spools 28 full of cord 14 are loaded upon the appropriate spindles 26 an operator loads a cord 14 into each appropriate slit 106. The comb 100 may then be rotated several times about the handle to allow for transfer of the organized cords from their respective spools to the roller boards. Alternatively, the operator may hold the handle 108 with one hand while grasping the cords with the other hand. The operator then walks the organized wires to the roller boards for loading. After each cord 14 is loaded and organized into the comb 100 from a row or a portion of a row of spools 28, the operator transports the comb 100 to the front roller board 16. It should be appreciated that the organized cords may also be transferred mechanically.

Prior to loading the roller board 16 the operator opens the closable flap 73 by actuating the spring loaded pin 78, rotating the hinge 72 upwardly and pivoting the cap bar 66 away from the spaces 42. Subsequently, the operator disengages the spring loaded pin 99 to release the uppermost latching mechanism and then unlatches each successive latching mechanism 86 by pushing up on the finger 90 of the uppermost horizontal roller 44 and pivoting the roller away from the plurality of vertical rollers 44 to allow open access to the spaces 42. This process is repeated for each horizontal roller 44 until the base roller 58 is exposed.

At this time, the operator aligns the cords 14 held in the comb 100 over the appropriate space 42 and inserts the cords accordingly. Once the cords 14 rest upon the base roller 58, the successive lowermost horizontal roller 44 is pivoted to enclose the cords 14 in the lower horizontal row of windows 48. The latching mechanism 86 is lifted slightly upward so that the leading edge 96 bears against the peg 88 until the peg 88 is engaged by the notch 98. Once the latching mechanism 86 is secured in place, the cords 14 are captured in the appropriate windows 48 and may be transferred to the calender or await loading of the other wires.

The operator then repeats the process of loading a comb 100 and inserting the loaded cords 14 into their appropriate spaces 42 until all the horizontal rollers 44 are pivoted and latched into place. Upon closure of the last horizontal roller 44, the cap bar 66 is pivoted into position to receive the axles 62 in the notches 74. The flap 73 is then closed and all of the cords 14 may then be transferred from the front roller board 16 to the main roller board 18 and then to the calender in a predetermined manner. It will be appreciated that the main roller board may also be provided with pivotable horizontal rollers.

It will be appreciated that the front roller board 16 used in conjunction with the creel system 10 provides numerous advantages over other cord organizing systems. In particular, the loading of the front roller board 16 is faster and more efficient than the use of eyelet plates or roller boards without pivotable horizontal rollers. The operator is not required to place each individual cord into a window nor is the operator required to work at eye level to stoop down or stand at various heights in order to thread each cord through a respective window. By employing the front roller board 16, the downtime of the cord organizing system 10 is greatly reduced and enhances the efficiency of a tire making operation. Another advantage of the present invention is that the occurrences of cord entanglement is greatly reduced by use of the comb 100 in conjunction with the front roller board 16.

Thus, it should be evident that the organizing system 10, which employs a front roller board 16 with pivotable horizontal rollers, carries out the various objects of the invention set forth hereinabove and otherwise constitutes an advantageous contribution to the art. As may be apparent to the person skilled in the art, modifications can be made to the preferred embodiments disclosed herein without departing from the spirit of the invention. Accordingly, for an appreciation of the true scope and breadth of the invention, reference should be made to the following claims.

I claim:

1. A roller board for organizing a plurality of filaments from spools for delivery to a collection point, comprising:

a first plurality of rollers arranged to form spaces therebetween; and a second plurality of rollers, each pivotable at one end positioned proximate said first plurality of rollers, said second plurality of rollers oriented substantially perpendicular to said first plurality of rollers, wherein the plurality of filaments are individually positioned in said spaces and said second plurality of rollers are selectively pivoted to enclose the cords.

2. The roller board according to claim 1, further comprising:

a base for rotatably mounting said first plurality of rollers in a substantially vertical and planar orientation.

3. The roller board according to claim 1, further comprising:

a base having an upwardly extending pivot pin to support one end of said second plurality of rollers, wherein each of said second plurality of rollers pivots about said pivot pin in a substantially horizontal plane.

4. The roller board according to claim 1, further comprising:

latches for positioning said second plurality of rollers in a plane substantially parallel to a plane formed by said first plurality of rollers, wherein said spaces receive filaments therein and said latches secure at least one end of said second plurality of rollers to enclose the filaments.

5. The roller board according to claim 1, further comprising:

a base;

a first vertical column extending vertically from an end of said base;

a second vertical column extending vertically from an opposite end of said base;

a pivot pin base connected to said first vertical column from which a pivot pin extends vertically;

wherein said first plurality of rollers extend substantially vertically from said base, and wherein said second plurality of rollers extend substantially horizontally from said pivot pin.

6. The roller board according to claim 5, wherein each of said second plurality of rollers comprises:

a block pivotable about said pivot pin;

a cantilevered axle secured to said block and about which each said roller rotates; and means for latching extending from said axle at an end opposite said block, said latch means detachably coupled to said second vertical column.

7. The roller board according to claim 6, wherein said latch means comprises:

a finger rotatable on said cantilevered axle; and a rib with a notch extending from said finger, wherein said second vertical column has a plurality of pegs extending therefrom, each said peg fitting within said notch to latch each of said second plurality of rollers.

8. The roller board according to claim 5 further comprising:

a cap pin extending from said first vertical column; and a cap bar pivotable upon said cap pin, said cap bar coupled to said first plurality of rollers to enclose said spaces, wherein said first plurality of rollers have a tapered top to facilitate entry of the plurality of filaments in said spaces.

9. The roller board according to claim 8 wherein each of said first plurality of rollers include a vertical axle extending up from said base and a spacer collar interposed between said axle and each said first plurality of rollers, and wherein said cap bar has a notch aligned with each vertical axle to enclose the same.

10. A system for delivering filaments from a creel to a calender for calendering tire plies, comprising:

a creel for carrying a plurality of spools of filament, wherein said plurality of spools are arranged in a matrix of rows and columns;

a main roller board for arranging filaments from said plurality of spools in a planar configuration of predetermined width; and a front roller board interposed between said creel and said main roller board, wherein said front roller board comprises a) a first plurality of rollers arranged to form spaces therebetween; and b) a second plurality of rollers proximally positioned near and oriented substantially perpendicular to said first plurality of rollers, each of said second plurality of rollers pivotable to enclose a filament within said space and between adjacent rollers of said second plurality of rollers.

11. The system according to claim 10, further comprising:

a clamping device having a plurality of slits for receiving and engaging a filament therein, said slits aligned with said spaces wherein a filament is inserted into each appropriate slit and wherein the clamping device assists in directing the filaments held therein into said spaces.

12. The system according to claim 11, wherein said first plurality of rollers is substantially vertically oriented and said second plurality of rollers are substantially horizontally oriented and individually pivotable and wherein said filaments are received in respective spaces and enclosed by pivoting a horizontal roller into a plane parallel with a plane of said first plurality of rollers.

13. The system according to claim 12, wherein said front roller board further comprises:

latches for maintaining said second plurality of rollers in a plane parallel with the plane of said first plurality of rollers.

14. The system according to claim 12, wherein said front roller board further comprises:

a base from which said vertical rollers extend; and a pivot block coupled to said base, said pivot block having a pivot pin extending therefrom about which said second plurality of rollers individually pivot.

15. The system according to claim 14, wherein each of said second plurality of rollers has means for latching at an end opposite said pivot pin that latches to a column extending from said base to hold said second plurality of rollers in the plane parallel with the plane of said plurality of vertical rollers.

16. A method for threading filaments through a roller board, comprising the steps of:

a) providing a comb having a plurality of slits along at least one edge;

b) inserting at least one filament into one of said plurality of slits;

c) transporting said comb to a roller board, said roller board comprising:

a first plurality of rollers having spaces therebetween, and a second plurality of rollers, each pivotable at one end, oriented substantially perpendicularly to said first plurality of rollers;

d) inserting the at least one filament into an appropriate space;

e) latching one of said second plurality of rollers to enclose the at least one filament in the appropriate space; and f) repeating steps a)–e) until all of said second plurality of rollers are latched.

17. The method of claim 16, further including the step of:

providing said slits with the same center-to-center spacing as said spaces.

18. The method of claim 16, further comprising the steps of:

a) pulling the at least one filament from a first spool carried by a creel and inserting the filament into a first slit in the comb;

b) pulling a filament from a spool adjacent the first spool and inserting the filament into a slit adjacent the first slit; and c) repeating steps a) and b) until all the desired number of slits are occupied by a filament.

19. The method of claim 18, further comprising the steps of:

a) inserting the filaments held by the comb into respective said spaces;

b) latching the lowermost of said second plurality of rollers to enclose the filaments;

c) pulling a filament from a first spool of a next row of spools carried by the creel and inserting the filament into a first slit of a next comb;

d) pulling filaments from spools adjacent one another in the next row until all the slits of the next comb are full;

e) inserting filaments held by the next comb into respective said channels; and f) latching the lowermost of said second plurality of rollers to enclose the filaments from the next row; and g) repeating steps c) through f) until the roller board is full.

20. The method according to claim 19, wherein the step of latching comprises the steps of:

a) providing an axle through each of said second plurality of rollers;

b) providing means for latching at the end of said axle opposite the pivot end;

c) providing a like plurality of means for receiving latches on said roller board; and d) securing said means for latching on said latch receiving means.

21. The method according to claim 20, further comprising the step of pivoting a cap bar carried by said roller board to enclose the spaces after all of said second plurality of rollers are latched into place.

* * * * *